US005986394A

United States Patent [19]

Jeon et al.

[11] Patent Number: 5,986,394

[45] Date of Patent: Nov. 16, 1999

[54] ELECTRON GUN FOR COLOR CATHODE RAY TUBE

[75] Inventors: Gwan-chan Jeon, Seoul; Kue-hong Lee; Deog-ho Kim, both of Suwon, all of Rep. of Korea

[73] Assignee: Samsung Display Devices Co., Ltd., Kyungki-do, Rep. of Korea

[21] Appl. No.: 08/924,648

[22] Filed: Sep. 5, 1997

[30] Foreign Application Priority Data

Sep. 6, 1996 [KR] Rep. of Korea ..... 96-38755

[51] Int. Cl.[6] ..... H01J 29/58

[52] U.S. Cl. ..... 313/414; 313/449; 313/413; 315/15; 315/382

[58] Field of Search ..... 513/412, 414, 513/449, 413; 315/14, 15, 382

[56] References Cited

U.S. PATENT DOCUMENTS 5,404,071 4/1995 Son ..... 313/414
5,633,567 5/1997 Spanjer ..... 313/414
5,747,922 5/1998 Sukeno et al. ..... 313/414

FOREIGN PATENT DOCUMENTS 0517351 12/1992 European Pat. Off. .
0698906 2/1996 European Pat. Off. .
0762464 3/1997 European Pat. Off. .
2034516 6/1980 United Kingdom .
2224883 5/1990 United Kingdom .
2303737 2/1997 United Kingdom .

*Primary Examiner*—Ashok Patel
*Attorney, Agent, or Firm*—Leydig, Voit & Mayer, Ltd.

[57] ABSTRACT

An electron gun for a color cathode ray tube includes cathode, control and screen electrodes, forming a triode. The electron gun includes first, second and third focus electrodes, forming main and auxiliary lenses. A final accelerating electrode faces the third focus electrode. A static voltage is applied to the screen electrode and the second focus electrode. A dynamic focus voltage is applied to the first and third focus electrodes. First and second quadrupole lenses are formed.

9 Claims, 5 Drawing Sheets

ELECTRON GUN FOR COLOR CATHODE RAY TUBE

BACKGROUND OF THE INVENTION

The present invention relates to an electron gun for a color cathode ray tube, and more particularly, to an electron gun for a color cathode ray tube, in which a method for applying voltages to electrodes for forming an electron beam is enhanced.

The resolution of the color cathode ray tube depends on the size of an electron beam landing on a fluorescent film. Accordingly, in order to obtain an image having a high resolution, the electron beams landing on the fluorescent film are required to be small in size and have no defect and without a "halo" effect.

However, a typical electron gun emits electron beams inline to excite red(R), green(G) and blue(B) phosphors. The electron beams emitted from the electron gun are deflected by a deflection yoke for forming a pincushion horizontal deflection magnetic field and a barrel vertical deflection magnetic field. Here, due to an uneven magnetic field of the deflection yoke, astigmatism in the electron beams is generated.

That is, while the electron beams emitted from the electron gun land at the center of the fluorescent film, the deflection magnetic field is not applied. Accordingly, astigmatism of the electron beams is not generated, so that a circular electron beam spot without a halo is obtained. However, due to deflection by the magnetic field, the electron beams deflected to a peripheral portion of the fluorescent film diverge in a horizontal direction and are excessively focused in a vertical direction. Accordingly, an image including a core portion of high luminance and a halo portion of low luminance, is formed on the screen, to thereby deteriorate the resolution of the screen.

FIG. 1 shows an example of a conventional electron gun for a color cathode ray tube for solving the above problems.

The electron gun 1 includes a cathode 2, control and screen electrodes 3 and 4 forming a triode, first, second, third and fourth focus electrodes 5, 6, 7 and 8 forming a main electron lens system, and a final accelerating electrode 9 facing the fourth focus electrode 8. Three cathodes 2 are arranged, and three electron beam passing holes are formed in-line with the electrodes facing the cathodes 2.

A predetermined static voltage VS is applied to the screen electrode 4 and the second focus electrode 6. As shown in FIGS. 1 and 2, a focus voltage VF higher than the static voltage VS is applied to the first and third focus electrodes 5 and 7, a dynamic focus voltage VD in which the focus voltage is used as a base voltage is applied to the fourth focus electrode 8, and an anode voltage VA higher than the above voltages is applied to the final accelerating electrode 9.

In the above-described conventional electron gun for a color cathode ray tube, in the case that electron beams are not deflected, i.e., when the electron beams emitted from the electron gun 1 are scanned to the center of the fluorescent film, a minimum dynamic focus voltage VD is applied to the fourth focus electrode 8. Accordingly, a quadrupole lens is not formed between the third and fourth focus electrodes 7 and 8. The electron beams emitted from the cathode 2 are focused and accelerated by a electron lenses formed between the electrodes, to land as circles on the center of the fluorescent film.

When the electron beams emitted from the electron gun are scanned to the peripheral portion of the fluorescent film, the dynamic focus voltage VD is applied to the fourth focus electrode 8, to form a quadrupole lens between the third and fourth focus electrodes 5 and 8. Accordingly, a section of the electron beams emitted from the cathode 2 and then passing through the quadrupole lens is vertically-elongated. The distortion of the electron beams of the peripheral portion of the fluorescent film due to an uneven magnetic field of the deflection yoke is corrected by the vertically-elongated electron beams.

However, the quadrupole lens of the conventional electron gun for a color cathode ray tube is formed by the focus voltage VF and the dynamic focus voltage VD, so that a circuit for applying multiple voltages becomes complicated. Also, the electrode where the focus voltage is applied and the electrode where the dynamic focus voltage is applied are additionally required, so that the number of electrodes increases, and thus the structure becomes complicated and the length of the electron gun increases.

SUMMARY OF THE INVENTION

To solve the above problems, it is an object of the present invention to provide an electron gun for a color cathode ray tube capable of forming an even section of electron beams landing on a fluorescent film and enhancing internal voltage characteristics thereof.

To accomplish the above object of the present invention, the electron gun for a color cathode ray tube includes cathode, control, and screen electrodes forming a triode, first, second and third focus electrodes forming main and auxiliary lenses, a final accelerating electrode facing the third focus electrode, a quadrupole lens formation means formed on surfaces facing the first, second and third focus electrodes, in which a static voltage is applied to the screen electrode and the second focus electrode, and a dynamic focus voltage forming the second focus electrode and the quadrupole lens is applied to the first and third focus electrodes.

In the quadrupole lens formation means, vertically-elongated electron beam passing holes are formed on each outgoing plane of the first and second focus electrodes, and horizontally-elongated electron beam passing holes are formed on each incoming plane of the second and third focus electrodes.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
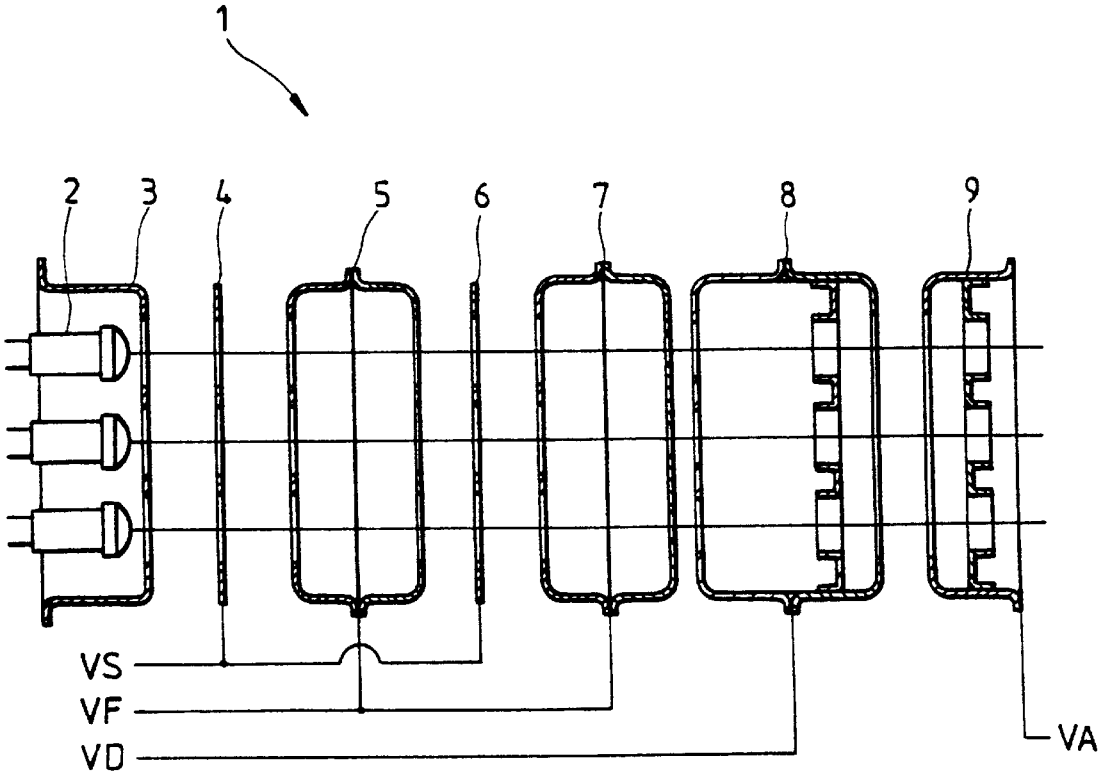
FIG. 1(PRIOR ART)
FIG. 1 is a sectional view of a conventional electron gun for a color cathode ray tube, and the structure by which voltages are applied to each electrode.
Figure 2:
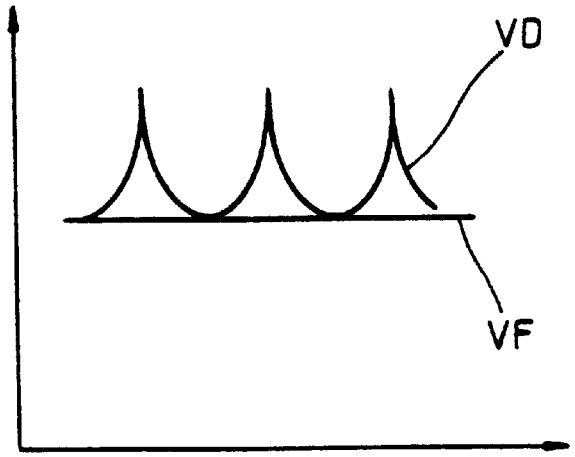
FIG. 2(PRIOR ART)
FIG. 2 shows the voltage waveforms for forming a quadrupole lens in a conventional electron gun.
Figure 3:
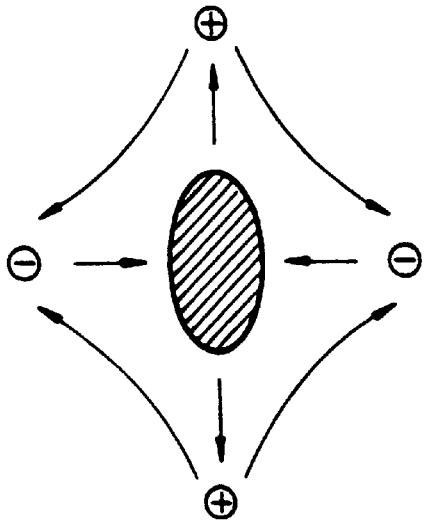
FIG. 3(PRIOR ART)
FIG. 3 is a sectional view of an electron beam passing through a lens formed by the conventional electron gun.
Figure 4:
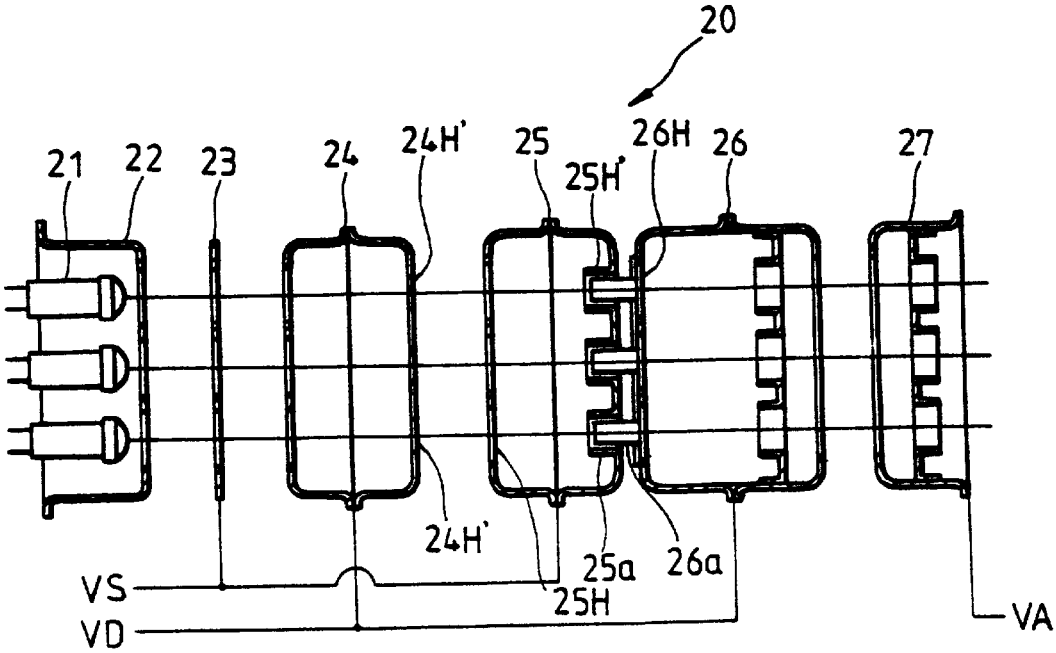
FIG. 4 is a sectional view of an electron gun for a color cathode ray tube according to the present invention, and application of voltages therein.
Figure 5:
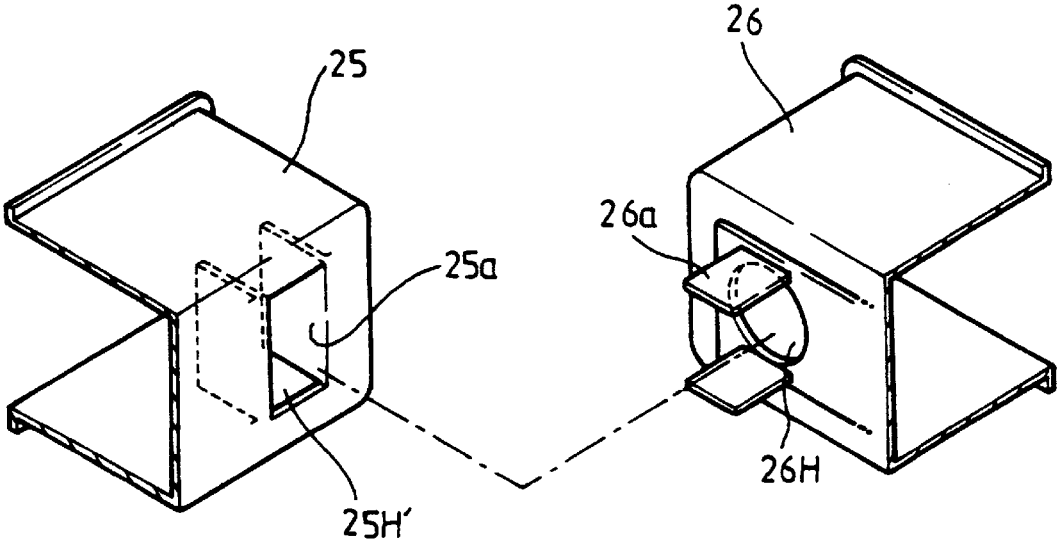
FIG. 5 is a partially cutaway perspective view of a quadrupole lens formation means of FIG. 4.

As shown in FIG. 4, the electron gun for a cathode ray tube according to the present invention includes a cathode 21 forming a triode, a control electrode 22 and a screen electrode 23, first, second and third focus electrodes 24, 25 and 26 including first and second quadrupole lenses formation means, for forming auxiliary and main lenses, and a final accelerating electrode 27 facing the third focus electrode 26. Three cathodes 21 are arranged in-line and each of the electrodes includes three electron beam passing holes for forming an electron lens or one common electron beam passing hole for forming a lens having a large diameter. At this time, first and second quadrupole lens formation units for forming the quadrupole lenses when a voltage is applied are formed between the first and second focus electrodes 24, 25, and between the second and third focus electrodes 25 and 26, respectively. The first quadrupole lens formation unit includes a vertically-elongated electron beam passing hole 24H' and a horizontally-elongated electron beam passing hole 25H formed on an outgoing plane of the first focus electrode 24 and an incoming plane of the second focus electrode 25, respectively. The second quadrupole lens formation unit, as shown in FIG. 5, includes a rectangular electron beam passing hole 25H' formed on an outgoing plane of the second focus electrode 25, a vertical blade 25*a* extending to the inside of the electrode from both edges of the electron beam passing hole 25H', an electron beam passing hole 26H formed on an incoming plane of the third focus electrode 26, and a horizontal blade 26*a* extending from the upper and lower portions of the electron beam passing hole 26H to the inside of the second focus electrode 25 through the electron beam passing hole 25H' to avoid contact with the vertical blade 25*a* and the second focus electrode 25.

Figure 6:
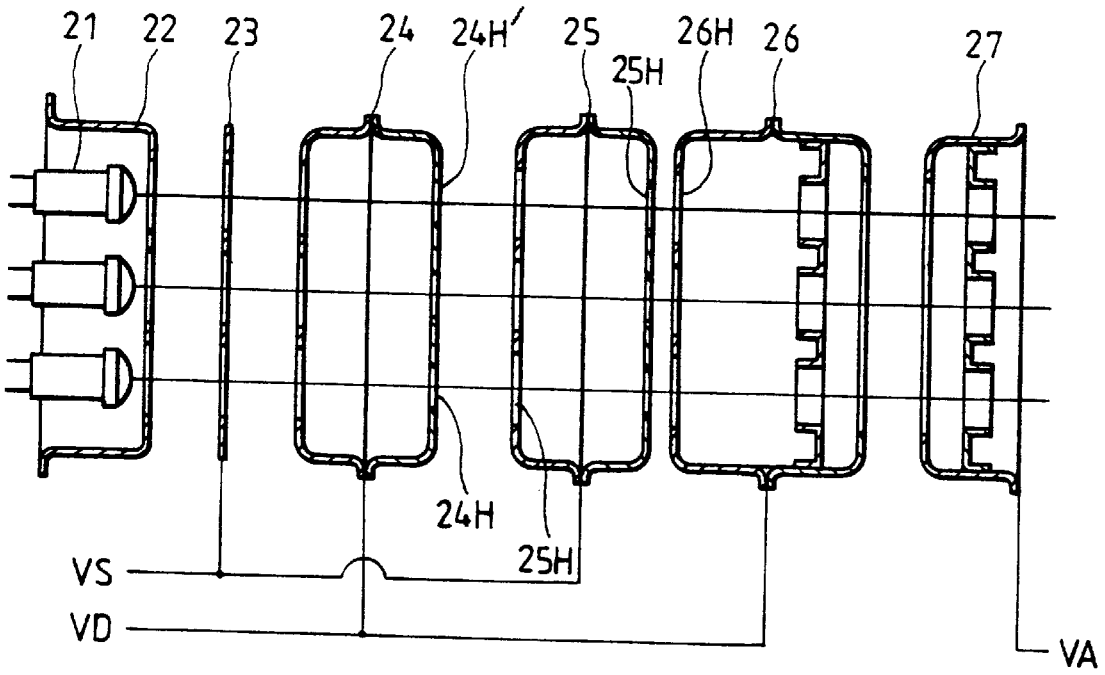
FIG. 6 is a sectional view showing another embodiment of an electron gun according to the present invention.
Figure 7:
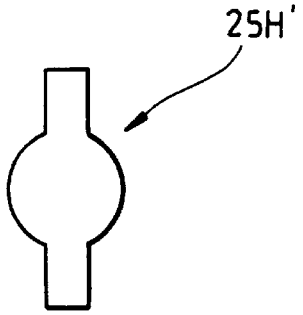
FIG. 7 shows a vertically-elongated electron beam passing hole of FIG. 6.
Figure 8:
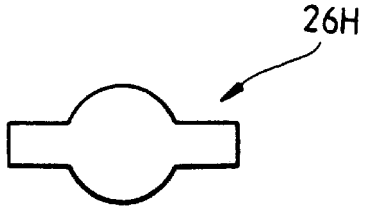
FIG. 8 shows of a horizontally-elongated electron beam passing hole of FIG. 6.

According to another embodiment, the electron beam passing holes 25H' and 26H formed on the outgoing plane of the second focus electrode 25 and the incoming plane of the third focus electrode 26 may be elongated vertically or horizontally, respectively, as shown in FIG. 6. Here, as shown in FIG. 7, the vertically-elongated electron beam passing hole 25H' is shaped in the form of a vertical key hole having a recessed groove formed on and under the circular electron beam passing hole, and as shown in FIG. 8, the horizontally-elongated electron beam passing hole 26H is shaped in the form of a horizontal key hole having recessed grooves formed on both sides of the circular electron beam passing hole. The vertically and horizontally-elongated electron beam passing holes are not limited to the illustrated embodiment, and may be shaped in the form of a rectangle or an ellipse.

Also, a predetermined voltage is applied to each electrode for forming the electron gun 20, which will be described in detail with reference to FIG. 6.

A voltage of −100 V to 0 V is applied to the control electrode 22, a static voltage VS of 400 V to 1000 V is applied to a screen electrode 23 and a second focus electrode 25, and a dynamic focus voltage VD of 5~10 KV higher than the static voltage VS is applied to the first and third focus electrodes 24 and 26. An anode voltage VA of 25~30 KV, which is higher than the other voltages, is applied to a final accelerating electrode 27. The voltage applied to each of the above electrodes is not limited to the illustrated embodiments, and can be controlled according to the magnification of an electronic lens to be formed between the electrodes.

The operation of the electron gun for a color cathode ray tube when electron beams emitted from the electron gun are scanned to a center of a fluorescent film and a peripheral portion thereof, will be described as follows.

In the case that the electron beams emitted from the electron gun 20 are scanned to the center of the fluorescent film, a minimum dynamic focus voltage VD is applied to the first and third focus electrodes 24 and 26, so that an electronic lens is not formed, or quadrupole lenses having a relatively much lower magnification are formed by the first, second and third focus electrodes 23, 24 and 25. A main electronic lens is formed between the third focus electrode 26 and the final accelerating electrode 27. Accordingly, the electron beams emitted from the electron gun are focused or accelerated as they pass through the main lens, and thus circular electron beams land on the center of the fluorescent film.

Figure 9:
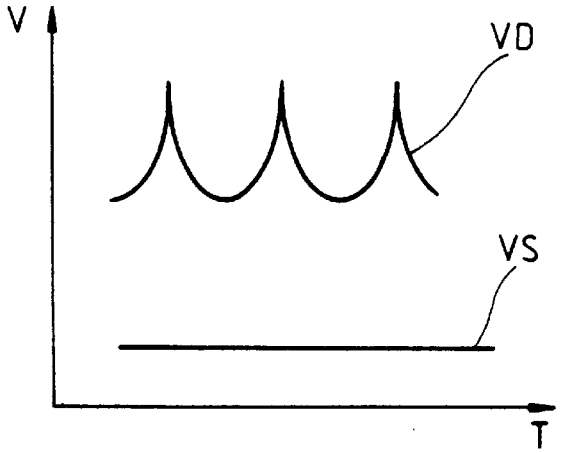
FIG. 9 shows the voltage waveforms for forming the quadrupole lens of the electron gun according to the present invention.

When the electron beams emitted from the electron gun 20 are scanned to a peripheral portion of the fluorescent film, as shown in FIG. 9, the static voltage VS is applied to the screen electrode 23 and the second focus electrode 25, a parabola type dynamic focus voltage VD is applied to the first and third focus electrodes 24 and 26, and also a high anode voltage VA is applied to the final accelerating electrode 27. Accordingly, a cathode lens and an electronic lens are formed between the control electrode 22 and the screen electrode 23, and the screen electrode 23 and the first focus electrode, respectively. A first quadrupole lens is formed between the first focus electrode 24 and the second focus electrode 25 by a vertically-elongated electron beam passing hole 24H' formed on the outgoing plane of the first focus electrode 24 and a horizontally-elongated beam electron passing hole 25H formed on the incoming plane of the second focus electrode 25, and a second quadrupole lens is formed between the second focus electrode 25 and the third focus electrode 26 by the vertical blade 25*a* and the horizontal blade 26*a*.

Figure 10:
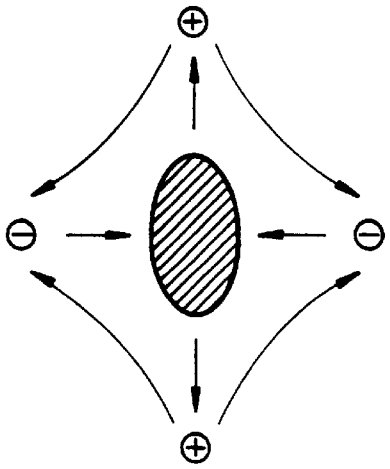
FIG. 10 is a sectional view of an electron beam passing through the electron gun.

Therefore, the electron beams emitted from the cathode 21 as they pass through the first quadrupole lens, are horizontally-elongated, and then are vertically-elongated as they pass passing through the second quadrupole lens. Finally, a section of the electron beams incident to the main lens is vertically-elongated, as shown in FIG. 10. Accordingly, a double quadrupole lens formed by a relatively low screen voltage and a relatively high dynamic focus voltage prevents excessive focusing in a vertical direction of electron beams, and limits excessive divergence in a horizontal direction. As described above, the electron beams horizontally-elongated while passing through the first quadrupole lens, and vertically-elongated while passing through the second quadrupole lens are finally focused and accelerated while passing through the main lens, to scan to the fluorescent film, and thus astigmatism due to an uneven magnetic field of the deflection yoke is corrected. The magnifications of the first and second quadrupole lenses are controlled using the intensity of a voltage applied to the electrode, to thereby diverge electron beams horizontally and focus the electron beams vertically. Accordingly, the section of the electron beams landing on a peripheral portion of the fluorescent film is circular.

According to the electron gun for a color cathode ray tube of the present invention, astigmatism and a "halo" effect due to deflection are reduced, to thereby shape a section of the electron beams landing on a peripheral portion of the fluorescent film in the form of a circle. Accordingly, the resolution of an image can be enhanced.

Also, simplified voltages applied to each of the electrodes simplify the circuit structure, and the electrode structure is also simplified, to thereby enhance the operational effect and productivity.

According to the electron gun for a color cathode ray tube of the present invention, electron beams emitted from a cathode are focused and accelerated, to reduce the astigmatism of a screen and spherical aberration thereof, and focus characteristics are enhanced, to obtain a uniform electron beam section.

The electron gun for a color cathode ray tube according to the present invention is not limited to the illustrated embodiment, and can be formed in various ways using a method of applying a voltage according to the present invention.

What is claimed is:

1. An electron gun for a color cathode ray tube comprising:

a cathode, a control electrodes and a screen electrode for forming a triode;

first, second, and third focus electrodes for forming an auxiliary lens and a main lens;

a final accelerating electrode facing said third focus electrode;

a first quadrupole lens formation unit for forming a first quadrupole lens between said first and second focus electrodes; and a second quadrupole lens formation unit for forming a second quadrupole lens between said second and third focus electrodes, wherein a static voltage is applied to said screen electrode and said second focus electrode, and a dynamic focus voltage for forming said first and second quadrupole lenses is applied to said first: and third focus electrodes.

2. The electron gun for a color cathode ray tube according to claim 1, wherein the dynamic focus voltage is higher than the static voltage.

3. The electron gun for a color cathode ray tube according to claim 1, wherein said first quadrupole lens formation unit comprises:

an elongated electron beam passing hole in said first focus electrode, aligned along a first direction, and facing said second focus electrode, and an elongated electron beam passing hole in said second focus electrode, aligned along a second direction, transverse to the first direction, and facing said first focus electrode.

4. The electron gun for a color cathode ray tube according to claim 1, wherein said second quadrupole lens formation unit comprises:

a first electron beam passing hole in said second focus electrode, facing said third focus electrode, and first and second generally parallel blades extending from said second focus electrode along opposite edges of the first electron beam passing hole and protruding into an interior region of said second focus electrode; and a second electron beam passing hole in said third focus eletrode, facing said second focus electrode, and third and fourth generally parallel blades, transverse to said first and second blades, extending from said third focus electrode at opposite edges of the second electron beam passing hole, through said first electron beam passing hole, and into the interior region of said second focus electrode, said first and second blades being spaced from said third and fourth blades and from said second focus electrode.

5. The electron gun for a cathode ray tube according to claim 4, wherein the first electron beam passing hole is rectangular.

6. The electron gun for a color cathode ray tube according to claim 3, wherein said second quadrupole lens formation unit comprises:

a first electron beam passing hole in said second focus electrode, facing said third focus electrode, and including a first circular hole centrally located in a first rectangular hole having a length aligned along a third direction and a width, the first circular hole having a diameter larger than the width of the first rectangular hole; and a second electron beam passing hole in said third focus electrode, facing said second focus electrode, and including a second circular hole centrally located in a second rectangular hole having a length aligned along a fourth direction, transverse to the third direction, and a width, the second circular hole having a diameter larger than the width of the second rectangular hole.

7. The electron gun for a cathode ray tube according to claim 5, wherein the second electron beam passing hole is circular.

8. The electron gun for a color cathode ray tube according to claim 1, wherein:

said first quadrupole lens formation unit comprises:

an elongated electron beam passing hole in said first focus electrode, aligned along a first direction, and facing said second focus electrode, and an elongated electron beam passing hole in said second focus electrode, aligned along a second direction, transverse to the first direction, and facing said first focus electrode; and said second quadrupole lens formation unit comprises:

a first electron beam passing hole in said second focus electrode, facing said third focus electrode, and first and second generally parallel blades extending from said second focus electrode along opposite edges of the first electron beam passing hole and protruding into an interior region of said second focus electrode; and a second electron beam passing hole in said third focus electrode, facing said second focus electrode, and third and fourth generally parallel blades, transverse to said first and second blades, extending from said third focus electrode at opposite edges of the second electron beam passing hole, through said first electron beam passing hole, and into the interior region of said second focus electrode, said first and second blades being spaced from said third and fourth blades and from said second focus electrode.

9. The electron gun for a cathode ray tube according to claim 8, wherein the first electron beam passing hole in said second focus electrode is rectangular and the second electron beam passing hole in said third focus electrode is circular.

* * * * *